US010184485B2

(12) United States Patent
Horsley et al.

(10) Patent No.: US 10,184,485 B2
(45) Date of Patent: Jan. 22, 2019

(54) METHOD OF MANUFACTURING A COMPRESSOR HOUSING

(71) Applicant: Cummins Ltd, Huddersfield (GB)

(72) Inventors: John R. Horsley, Holmfirth (GB); Farhan Nazir, Huddersfield (GB); Jamie Archer, Holmfirth (GB)

(73) Assignee: Cummins Ltd., Huddersfield (GB)

( * ) Notice: Subject to any disclaimer, the term of this patent is extended or adjusted under 35 U.S.C. 154(b) by 113 days.

(21) Appl. No.: 15/316,243

(22) PCT Filed: Jun. 4, 2015

(86) PCT No.: PCT/GB2015/051630
§ 371 (c)(1),
(2) Date: Dec. 5, 2016

(87) PCT Pub. No.: WO2015/185932
PCT Pub. Date: Dec. 10, 2015

(65) Prior Publication Data

US 2017/0184121 A1 Jun. 29, 2017

(30) Foreign Application Priority Data

Jun. 5, 2014 (GB) ..... 1409976.6

(51) Int. Cl.
*B22D 17/00* (2006.01)
*F04D 29/42* (2006.01)
(Continued)

(52) U.S. Cl.
CPC ..... *F04D 29/4206* (2013.01); *B22C 9/10* (2013.01); *B22D 17/00* (2013.01); *F01D 5/04* (2013.01);
(Continued)

(58) Field of Classification Search
CPC ..... B22D 17/00; B22D 17/22; F04D 29/28; F04D 29/284; F04D 29/42; F04D 29/4206; F04D 29/444
(Continued)

(56) References Cited

U.S. PATENT DOCUMENTS 4,521,155 A * 6/1985 Osborn ..... F04D 25/04 415/190
5,779,406 A 7/1998 Astor
(Continued)

FOREIGN PATENT DOCUMENTS

CN 102308061 1/2012
CN 102812255 12/2012
(Continued)

OTHER PUBLICATIONS

International Search Report and Written Opinion issued by the European Patent Office, dated Aug. 19, 2015, for related International Application No. PCT/GB2015/051630; 9 pages.
(Continued)

*Primary Examiner* — Kevin P Kerns
(74) *Attorney, Agent, or Firm* — Faegre Baker Daniels LLP

(57) ABSTRACT

A method of manufacturing a compressor housing is provided including arranging a core with a die to define a mould cavity, solidifying a metal within the cavity to form a compressor housing having a diffuser first wall and an outlet volute first wall with an opening; the housing being formed such that a first angle is subtended between an outlet section of a surface of the diffuser first wall and a first section of a surface of the outlet volute first wall, wherein after the housing has been formed, the core is removed and a cut is applied, through the opening, to the first section of the surface of the outlet volute first wall to produce a cut section
(Continued)

such that a second angle is subtended between the cut section and the outlet section of the surface of the diffuser first wall that is greater than the first angle.

20 Claims, 9 Drawing Sheets

(51) Int. Cl.

| | |
|---|---|
| ***F04D 29/02*** | (2006.01) |
| ***F04D 29/44*** | (2006.01) |
| ***F04D 29/62*** | (2006.01) |
| ***B22C 9/10*** | (2006.01) |
| ***F01D 5/04*** | (2006.01) |
| ***F01D 25/16*** | (2006.01) |
| ***F02B 33/40*** | (2006.01) |
| ***F04D 29/053*** | (2006.01) |
| ***F04D 29/28*** | (2006.01) |

(52) U.S. Cl.
CPC ..... *F01D 25/16* (2013.01); *F02B 33/40* (2013.01); *F04D 29/023* (2013.01); *F04D 29/053* (2013.01); *F04D 29/284* (2013.01); *F04D 29/441* (2013.01); *F04D 29/444* (2013.01); *F04D 29/624* (2013.01); *F05D 2220/40* (2013.01); *F05D 2230/10* (2013.01); *F05D 2230/21* (2013.01); *F05D 2300/10* (2013.01)

(58) Field of Classification Search
USPC ..... 164/69.1, 132, 137
See application file for complete search history.

(56) References Cited

U.S. PATENT DOCUMENTS

| | | | | |
|---|---|---|---|---|
| 8,951,007 | B2 | 2/2015 | Botsch et al. | |
| 9,000,324 | B2 | 4/2015 | Moore et al. | |
| 9,677,568 | B2 | 6/2017 | Vetter et al. | |
| 9,889,501 | B2 | 2/2018 | Boening et al. | |
| 2013/0136578 | A1 | 5/2013 | Vetter et al. | |
| 2013/0272883 | A1* | 10/2013 | Paeng et al. ..... | F04D 29/284 416/188 |
| 2014/0056700 | A1 | 2/2014 | Rupp et al. | |
| 2014/0086726 | A1* | 3/2014 | Isogai ..... | F01D 9/026 415/73 |

FOREIGN PATENT DOCUMENTS

| | | |
|---|---|---|
| CN | 102900701 | 1/2013 |
| CN | 103042179 | 4/2013 |
| CN | 103124853 | 5/2013 |
| CN | 203035612 | 7/2013 |
| CN | 103629083 | 3/2014 |
| DE | 10 2006 036 240 | 2/2008 |
| DE | 102006036240 A1 | 2/2008 |
| WO | 2013/112345 | 8/2013 |

OTHER PUBLICATIONS

Chinese Office Action dated Jun. 8, 2018 in Application No. CN201580042048.1.
EP Office Action dated Aug. 2, 2018 in EP 15 728 109.8.

* cited by examiner

METHOD OF MANUFACTURING A COMPRESSOR HOUSING

CROSS-REFERENCE TO RELATED APPLICATIONS

This application is the national phase of International Application No. PCT/GB2015/051630, titled "METHOD OF MANUFACTURING A COMPRESSOR HOUSING", filed on Jun. 4, 2015, which claims the benefit of priority to British Patent Application No. 1409976.6, filed with the United Kingdom Intellectual Property Office on Jun. 5, 2014, the disclosures of which are expressly incorporated herein by reference.

FIELD OF THE DISCLOSURE

The present disclosure relates to a method of manufacturing a compressor housing for receiving an impeller to provide a compressor and relates particularly, but not exclusively, to a method of manufacturing a compressor housing for use in a turbocharger, such as a variable geometry turbocharger. The present disclosure also relates to a method of manufacturing a compressor and particularly, but not exclusively, to a method of manufacturing a compressor for use in a turbocharger, such as a variable geometry turbocharger.

BACKGROUND

A compressor comprises an impeller wheel, having a plurality of blades (or vanes) mounted on a shaft for rotation within a compressor housing. In the case of a centrifugal compressor, rotation of the impeller wheel causes gas (e.g. air) to be drawn into the impeller wheel and delivered to an outlet volute defined, at least in part, by the compressor housing around the impeller wheel.

One use of a compressor is in a turbocharger. Turbochargers are well known devices for supplying air to the intake of an internal combustion engine at pressures above atmospheric pressure (boost pressures). A conventional turbocharger essentially comprises a housing in which is provided an exhaust gas driven turbine wheel mounted on a rotatable shaft connected downstream of an engine outlet manifold. A compressor impeller wheel is mounted on the opposite end of the shaft such that rotation of the turbine wheel drives rotation of the impeller wheel. In this application of a compressor, the impeller wheel delivers compressed air to the engine intake manifold. The turbocharger shaft is conventionally supported by journal and thrust bearings, including appropriate lubricating systems.

A known centrifugal compressor housing comprises an axial intake, an annular diffuser and an annular outlet volute in the form of a scroll volute. An impeller, with a plurality of blades, is mounted on a shaft, for rotation about a longitudinal axis of the compressor housing, and is received between the axial intake and the outlet volute.

A radially inner surface of the axial intake forms an annular intake passage that extends axially inboard from an intake port to the impeller wheel.

The diffuser comprises first and second wall members having respectively opposed first and second surfaces that define an annular diffuser passage that surrounds the impeller and extends in a radially outward direction from an annular diffuser inlet downstream of said plurality of blades, the tips of the blades sweeping across said diffuser inlet during use, to an annular diffuser outlet communicating with the annular outlet volute. The diffuser outlet is formed by respective annular outlet ends of the first and second surfaces.

An inner surface of the outlet volute defines an annular outlet volute passage that extends, along a circumferentially extending volute passage axis, about the compressor housing longitudinal axis.

In use, as the impeller rotates, air is drawn in from the intake port, through the axial intake, to the impeller and passes from the impeller through the diffuser passage to the annular outlet volute passage. The compressed air passes along the outlet volute passage and out through a volute outlet to a desired location, e.g. to an engine intake manifold.

The inner surface of the volute extends, in a circumferential direction about the volute passage axis, from the annular outlet end of the first surface that defines the diffuser passage to the annular outlet end of the second surface that defines the diffuser passage. The inner surface has a generally constant radius, relative to the volute passage axis, such that the inner surface of the volute has a generally circular cross-sectional shape about the volute passage axis.

The inner surface of the volute has an annular first section that extends axially outboard (i.e. away from the diffuser passage) from the annular outlet end of the first surface that defines the diffuser passage.

It is known to form the first section of the inner surface of the volute such that it extends radially inwardly (relative to the compressor housing longitudinal axis) of the annular outlet end of the first surface that defines the diffuser passage to form a radially outwardly protruding annular lip, curved along its radial extent, that extends along the annular inlet end of the first surface. Providing this curved lip is advantageous in that it acts to better align the circulating flow in the outlet volute, as it passes from the first section of the inner surface of the volute towards the diffuser outlet, with the flow leaving the diffuser outlet, thereby reducing losses. The shape of the first section to form the lip is produced by appropriate shaping of the outer surface of a core around which the compressor housing is cast (for example a sand core or metal core, as described below).

An outlet volute may be formed from a single piece or from multiple pieces that are subsequently attached together.

It is known to use sand casting to produce a single piece closed volute with a cross sectional shape having this lip. In sand casting, a die is located around a sand core. A suitable bonding agent (usually clay) is typically mixed with the sand and the mixture is moistened, typically with water, but sometimes with other substances, to provide the strength and plasticity of the core suitable for moulding. The sand is compacted around a mould to provide the required shape of the core.

The die is positioned to enclose the sand core to define a mould cavity between an inner surface of the die and an outer surface of the sand core. Accordingly, an inner surface of the die defines the shape of the outer surface of the outlet volute (as well as of the diffuser and axial intake) and an outer surface of the sand core defines the shape of the inner surface of the outlet volute (as well as of the diffuser and axial intake).

Molten metal is injected into the mould cavity. Once the molten metal cools and solidifies, the die is removed and the sand core is removed from the inside of the compressor housing by tipping the sand particles out through the volute outlet.

Sand casting is disadvantageous in that, during the casting process, the shape of the sand core can change, resulting in dimensional inconsistency. In addition, it produces a relatively poor surface finish which, during use, results in losses in the flow.

It is also known to use pressure die casting to produce a multiple piece closed volute with this cross sectional shape. In pressure die casting molten metal is forced under pressure into a mould cavity. The mould cavity is defined between an inner surface of a die and an outer surface of a metal core located within the die.

In this process, multiple sections of the compressor housing (axially opposed sections) are formed separately, using pressure die casting, and are then assembled together to form a volute inner surface with the above cross sectional shape (a circular cross-sectional shape provided with said lip). Pressure die casting is advantageous in that it provides a better surface finish than sand casting, which gives better performance and reduces losses in the flow. However, due to the interfaces between the multiple sections, the volute has problems of leakage and containment issues, resulting in losses and inefficiencies in the flow.

Furthermore, it is currently not possible to use pressure die casting to form a single piece volute having a cross sectional shape provided with said lip, since the lip would prevent the metal core from being removed out of the volute after the casting process is complete.

In addition, due to the relatively high tooling costs with pressure die casting, it is necessary for high volumes of the compressor housing to be manufactured in order for the manufacturing process to be economically viable.

It is an object of the present disclosure to obviate or mitigate one or more of the problems set out above. A further object of the present disclosure is to provide an alternative method of manufacturing a compressor housing, compressor and turbocharger. A yet further object of the present disclosure is to provide a compressor housing, compressor and turbocharger manufactured according to the alternative method.

SUMMARY

According to a first aspect of the disclosure there is provided a method of manufacturing a compressor housing comprising:

arranging a core with a die so as to define a mould cavity between a surface of the core and a surface of the die, the mould cavity having the shape of a compressor housing;

providing a molten metal within the mould cavity and solidifying the molten metal to form a compressor housing;

the compressor housing having a longitudinal axis and being for receipt of an impeller wheel, mounted for rotation about an axis;

the compressor housing comprising an annular diffuser first wall member having a surface for defining, with an opposed surface of an annular diffuser second wall member, an annular diffuser passage;

the surface of the first wall member of the diffuser extending radially outwardly from an annular inlet end to an annular outlet end and having an annular outlet section extending radially inwardly from the outlet end;

the compressor housing further comprising an annular outlet volute first wall member having a surface for defining, with a surface of an annular outlet volute second wall member, an annular outlet volute passage;

the surface of the annular outlet volute first wall member defining a volute channel that extends, along a circumferentially extending volute channel axis, about the compressor housing longitudinal axis;

the surface of the annular outlet volute first wall member having an annular inlet end, provided at the outlet end of the surface of the first wall member of the diffuser, the surface of the annular outlet volute first wall member having an annular first section that extends axially outboard from the annular inlet end;

the compressor housing being formed such that for at least one circumferential position about the compressor housing longitudinal axis, a first angle is subtended between the outlet section of the surface of the diffuser first wall member and the first section of the surface of the outlet volute first wall member;

the outlet volute first wall member being formed with an opening;

wherein after the compressor housing has been formed in the mould cavity, the core is removed from the volute channel;

once the core has been removed from the volute channel, a cut is applied, through the opening, to the first section of the surface of the outlet volute first wall member, at the least one circumferential position, to produce a cut section such that a second angle is subtended between the cut section and the outlet section of the surface of the diffuser first wall member, at said at least one circumferential position, that is greater than the first angle.

Applying a cut to the at least one circumferential position of the first section of the surface of the outlet volute first wall member that increases the angle subtended between this surface and the outlet section of the surface of the diffuser first wall member, at said at least one circumferential position, acts to better align the circulating flow in the outlet volute, as it passes from the first section of the inner surface of the volute towards the diffuser outlet, with the flow leaving the diffuser outlet, thereby reducing losses.

Accordingly, casting the compressor housing around a core within a die, removing the core and applying the above described cut through the opening in the outlet volute first wall member allows pressure die casting to be used to produce a single piece volute with a cross sectional shape that better aligns the circulating flow in the outlet volute with the flow leaving the diffuser, than was otherwise possible, since the core may be removed through the opening in the outlet volute, before the cut is made.

The method may be used with pressure die casting, which is advantageous in that it provides a good surface finish, which reduces losses in the flow.

The method is also advantageous when a core of a particulate material (such as sand) is used since the core may be supported through the opening in the outlet volute first wall member. This reduces any shifting of the particular core during the casting processes, providing increased dimensional consistency.

It will be appreciated that references to the surface of the first wall member of the diffuser extending radially outwardly from the inlet end to the outlet end, and to the annular outlet section extending radially inwardly from the outlet end, refer to the surface/section extending generally in the radial direction and do not necessarily require that the surface/section is substantially parallel to the radial direction. The surface of the first wall member of the diffuser may be curved.

In this regard, the surface of the first wall member of the diffuser may extend radially outwardly from the inlet end to the outlet end in a direction which is substantially parallel to the radial direction. Alternatively, the surface of the first wall member of the diffuser may extend radially outwardly from the inlet end to the outlet end in a direction which is inclined relative to the radial direction. The annular outlet section of the surface of the first wall member of the diffuser may extend radially inwardly from the outlet end in a direction which is substantially parallel to the radial direction. Alternatively, the annular section may extend radially inwardly from the outlet end in a direction which is inclined relative to the radial direction.

Similarly, it will be appreciated that references to something (e.g. a surface or wall member) extending in the radial or axial direction do not necessarily require that the surface is substantially parallel to the radial or axial direction respectively, but merely require that they have at least a component in the radial or axial direction respectively.

Similarly, it will be appreciated that references to the surface of the first wall member of the outlet volute having an annular first section that extends in the axially outboard direction refer to the surface extending generally in the axially outboard direction and do not necessarily require that the surface is substantially parallel to the axially outboard direction. In this regard, it will be appreciated that the outboard direction refers to the direction away from the diffuser passageway (the surface of the first wall member of the diffuser), and the inboard direction refers to the direction towards the diffuser passageway.

The cut may extend radially inwardly of the outlet end of the surface of the first wall member of the diffuser, at the at least one circumferential position. In this regard, the cut section may extend radially inwardly of the outlet end of the surface of the first wall member of the diffuser, at the at least one circumferential position. The cut section may form a lip that extends in the circumferential direction about the volute channel axis.

The cut may be at an oblique angle to the outlet section of the surface of the diffuser first wall member, at the at least one circumferential position. In this regard, the cut section may be at an oblique angle to the outlet section of the surface of the diffuser first wall member, at the at least one circumferential position. Preferably the cut section extends in a direction which has a component in both the axial and radial directions (relative to the longitudinal axis of the compressor housing).

The cut section may be at an angle to the outlet section of the surface of the diffuser first wall member, at the at least one circumferential position, that is greater than or equal to 270°, preferably greater than 270°. The cut section may be at an angle to said outlet section that is greater than 270° and less than or equal to 350°. Preferably the cut section is at an angle to said outlet section that is greater than or equal to 280° and less than or equal to 320°. Preferably the cut section is at an angle to said outlet section of substantially 290°.

It will be appreciated that angle of the cut made will be the same as the angle of the cut section.

Preferably the surface of the first wall member of the outlet volute extends in a circumferential direction about the volute channel axis, from the inlet end of said surface to a radially outer end of said surface (radially outer relative to the compressor housing longitudinal axis).

The surface of the first wall member of the outlet volute may have a radius, relative to the volute channel axis, that varies with the circumferential position of said surface about the volute channel axis.

Optionally, before the cut is applied, the first section of the surface of the first wall member of the outlet volute has a substantially constant radius, relative to the compressor housing longitudinal axis, substantially along its length in the direction of the compressor housing longitudinal axis, the surface of the first wall member of the volute outlet has a radially outer section that extends axially outboard of the radially outer end of said surface and has a substantially constant radius across its length in the direction of the compressor housing longitudinal axis, said surface also having a base section extending between the first section and the radially outer section. Preferably the base section is curved along its length in the circumferential direction about the volute channel axis. Preferably, along its length in the circumferential direction about the volute channel axis, the base section has a substantially constant radius, relative to the volute channel axis.

In this regard, before the cut is made, the surface of the outlet volute first wall member may form a substantially D-shaped cross-sectional shape, about the volute channel axis.

Alternatively, before the cut is made, the surface of the first wall member of the outlet volute may have a radius, relative to the volute channel axis, that is substantially constant with the circumferential position of said surface (about the volute channel axis). In this regard, the surface of the outlet volute first wall member may form a substantially circular cross-sectional shape, about the volute channel axis.

The cut section may extend from a first end, to a second end, in the circumferential direction about the volute channel axis.

The first end of the cut section may be provided at the inlet end of the surface of the first wall member of the outlet volute, at the at least one circumferential position.

Alternatively, the first end of the cut section may be disposed at a point between the inlet end of the surface of the first wall member of the outlet volute and the radially outer end of said surface.

It will be appreciated that the angles referred to above (and below) are the external angles subtended by the outwardly facing respective surfaces (as opposed to the internal angle subtended by these surfaces).

The cut section may have a length in the circumferential direction, about the volute channel axis, that is less than or equal to half the length of the surface of the first wall member of the outlet volute in the circumferential direction, about the volute channel axis. Said length of the cut section may be less than or equal to 50% of said length of the surface of the first wall member of the outlet volute, preferably less than or equal to 50% and greater than or equal to 5%, more preferably less than or equal to 40% and greater than or equal to 10% and even more preferably less than or equal to 30% and greater than or equal to 20% of said length.

The angle of the cut section relative to the outlet section of the surface of the first wall member of the diffuser, at the at least one circumferential position, may vary along its length in the circumferential direction about the volute channel axis. In this case, the cut section may comprise a plurality of portions extending in said circumferential direction that are inclined at different angles relative to said outlet section.

The angle of the cut section relative to the outlet section of the surface of the first wall member of the diffuser, at the at least one circumferential position, may be substantially constant along its length in the circumferential direction about the volute channel axis. The cut section may be substantially straight in the circumferential direction about the volute channel axis. At least one, or each, portion may be substantially straight in the circumferential direction about the volute channel axis.

The plurality of portions may be arranged in an end to end configuration, in the circumferential direction about the volute channel axis. Where the cut section comprises said plurality of portions, the second angle may be the angle subtended between the portion that is nearest the inlet end of the surface of the first wall member of the outlet volute, and the outlet section of the surface of the diffuser first wall member, at said at least one circumferential position.

The plurality of portions may approximate a concave curve that faces into the volute channel.

The surface of the outlet volute first wall member may be at least partially curved from the inlet end of the surface of the first wall member of the outlet volute to the radially outer end of said surface and the plurality of portions may approximate a curve of substantially the same radius as the curvature of the surface of the outlet volute first wall member.

The cut section may be curved, or at least partially curved, along its length in the circumferential direction, about the volute channel axis.

Alternatively, the angle of the cut section relative to the outlet section of the surface of the first wall member of the diffuser may be substantially constant along its length in the circumferential direction, about the volute channel axis.

The cut may be made by a single cutting operation or by a plurality of cutting operations.

The at least one circumferential position may be a plurality of circumferential positions about the compressor housing longitudinal axis. The at least one circumferential position is preferably substantially every circumferential position about the compressor housing longitudinal axis. In this regard, the cut may be made at least partially around the circumference of the first section of the surface of the outlet volute first wall member, about the compressor housing longitudinal axis. Preferably the cut is made substantially around the entire said circumference of the first section of the surface of the outlet volute first wall member. Accordingly, the cut section may extend at least partially around the said circumference of the first section of the surface of the outlet volute first wall member. Preferably the cut section extends around substantially the entire said circumference of the first section (the circumference about the compressor housing longitudinal axis). The cut section may form a lip that extends in the circumferential direction about the compressor housing longitudinal axis.

In this regard the, or each portion, may be an annular portion that extends about the longitudinal axis of the compressor housing.

Preferably the cut section has a substantially constant shape with circumferential position about the compressor housing longitudinal axis. The length of the cut section, in the circumferential direction about the volute channel axis, is preferably substantially constant with circumferential position about the compressor housing longitudinal axis. The second angle is preferably substantially constant with circumferential position about the compressor housing longitudinal axis. This is advantageous in that it allows for a simpler machining operation to machine the cut. Specifically, it allows the cut to be machined in a single operation. This allows the cuts to be made using a lathe.

Alternatively, the cut section may have a varying shape with circumferential position about the compressor housing longitudinal axis, with said length of the cut section and/or said second angle, varying with said circumferential position. In order to produce such a circumferentially varying cut, a CNC lathe may be used.

Preferably the outlet end of the surface of the first wall member of the diffuser outlet has a radius that is substantially constant with circumferential position about the compressor housing longitudinal axis. This is advantageous in that it allows for a simpler machining operation to machine the cut. Specifically, it allows the cut to be machined in a single operation.

The cut may be made by applying a cutting surface of a cutting tool to the first section of the surface of the outlet volute first wall member and rotating the cutting tool relative to said surface. In this regard, the cutting surface may be stationary, with said surface of the outlet volute rotated, or vice versa. Preferably the cutting surface and/or the compressor housing is rotated about the longitudinal axis of the compressor housing.

The cut may be made by a single continuous rotation of said first section relative to the cutting surface.

Alternatively, the cut may be made by a plurality of rotations of said first section relative to the cutting surface.

Before the cut is made, the first section of the surface of the first wall member of the outlet volute, at the at least one circumferential position, may be of a substantially constant radius, relative to the compressor housing longitudinal axis, across the length of the first section in the circumferential direction about the volute channel axis. In this respect, before the cut is made, the first section may define a cylinder that extends in the axial direction, along a longitudinal axis that is centred on and coincident with the longitudinal axis of the compressor housing.

Before the cut is made, the first section may be substantially perpendicular to the outlet section of the surface of the diffuser first wall member, at the at least one circumferential position. In this regard, the first angle may be substantially 270°.

The outlet section of the surface of the diffuser first wall member, at the least one circumferential position, may be substantially planar. The outlet section, at the at least one circumferential position, may extend in a radial plane that is substantially perpendicular to the longitudinal axis of the compressor housing.

Preferably the compressor housing is formed as a single piece. The outlet volute is preferably formed as a single piece.

The core may be a solid core, such as a core made of metal or a metal alloy. The core may be made of any suitable material, including stainless steel or any suitable metal alloy. The molten metal may be injected into the mould cavity under pressure. In this respect, the compressor housing may be formed by a pressure die casting.

The core may be a core of a particulate material. In this respect, the core may be made of sand, or of any other suitable material. The molten metal may be provided in the mould cavity by being injected, or poured, into the mould cavity. The molten metal may be gravity fed into the mould cavity.

Preferably where the core is a core of a particulate material, the core is supported through the opening in the outlet volute first wall member. Preferably the core is supported through the opening across substantially the entire circumferential length of the core, about the compressor housing longitudinal axis. This is advantageous in that it reduces any shifting of the particular core during the casting processes, providing increased dimensional consistency.

Preferably the core is removed from the compressor housing through the opening in the outlet volute first wall member. Preferably where the core is a solid core, the core is removed from the compressor housing through the opening. This is advantageous as it allows pressure die casting to be used to produce a single piece volute with a cross sectional shape that better aligns the circulating flow in the outlet volute with the flow leaving the diffuser, than was otherwise possible. Where the core is a particulate core, such as sand, the core may be removed through the opening and/or through an outlet of the volute.

Preferably the opening is an annular opening. Preferably the opening extends about substantially the entire circumference of the longitudinal axis of the compressor housing. Preferably the opening extends across substantially the entire radial extent of the volute channel, relative to the longitudinal axis of the compressor housing.

The compressor housing preferably comprises an axial intake and an intermediary section that extends between the axial intake and the annular diffuser first wall member. The axial intake and/or the intermediary section may be integrally formed with the remainder of the compressor housing (e.g. the annular diffuser first wall member) or may be formed separately and subsequently attached thereto.

According to a second aspect of the disclosure there is provided a method of manufacturing a compressor comprising:

manufacturing a compressor housing according to the first aspect of the disclosure;

providing a body having an annular diffuser second wall member and an annular outlet volute second wall member, assembling the body with the compressor housing such that the surface of the annular diffuser first wall member and a surface of the annular diffuser second wall member define an annular diffuser passage and the surface of the annular outlet volute first wall member and a surface of the annular outlet volute second wall member define an annular outlet volute that is downstream of and in fluid communication with the diffuser passage;

mounting an impeller within the compressor housing, the impeller being mounted on a shaft for rotation about said longitudinal axis, the impeller having a plurality of blades, the diffuser passage surrounding the impeller, with the tips of the blades sweeping across said diffuser inlet during use.

The body may be a component of a turbo-machine, including a bearing housing and/or a diffuser plate.

The surface of the annular diffuser second wall member may be substantially parallel to the radial direction (relative to the compressor housing longitudinal axis). Alternatively, the surface of the annular diffuser second wall member may be inclined relative to the radial direction. The surface of the annular diffuser second wall member may be substantially parallel to the surface of the annular diffuser first wall member. The surface of the annular diffuser second wall member may be curved.

According to a third aspect of the disclosure there is provided a method of manufacturing a turbocharger comprising manufacturing a compressor according to the second aspect of the disclosure and assembling the compressor with a turbine and bearing assembly to form a turbocharger.

According to a fourth aspect of the disclosure there is provided a compressor housing manufactured by the method of the first aspect.

According to a fifth aspect of the disclosure there is provided a compressor manufactured by the method of the second aspect.

According to a sixth aspect of the disclosure there is provided a turbocharger manufactured by the method of the third aspect.

Other advantageous and preferred features of the disclosure will be apparent from the following description.

BRIEF DESCRIPTION OF THE DRAWINGS

Specific embodiments of the present disclosure will now be described, by way of example only, with reference to the accompanying drawings, in which.

DETAILED DESCRIPTION OF EMBODIMENTS OF THE DISCLOSURE

Figure 1:
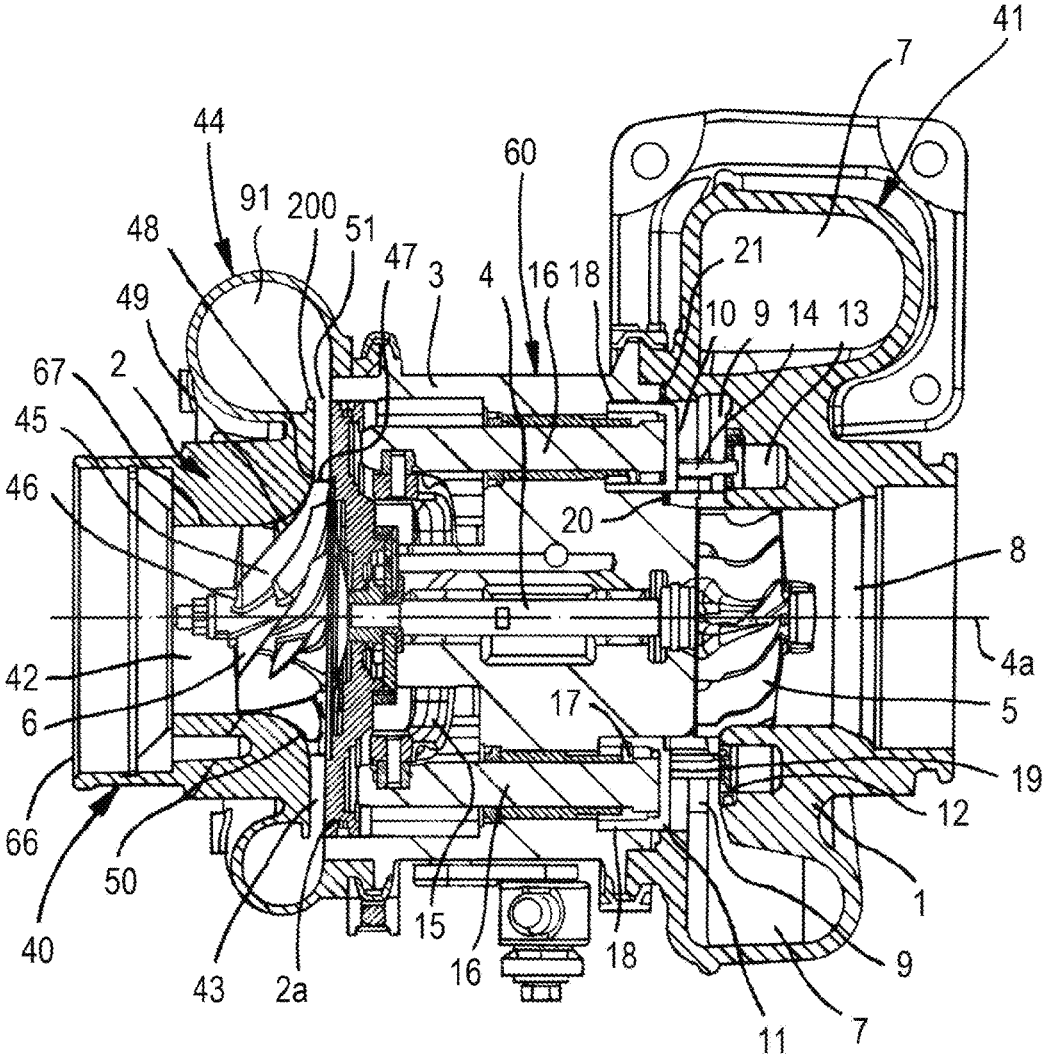
Fig. 1 (Prior Art)
FIG. 1 is an axial cross-section through a known variable geometry turbocharger.
Figure 2:
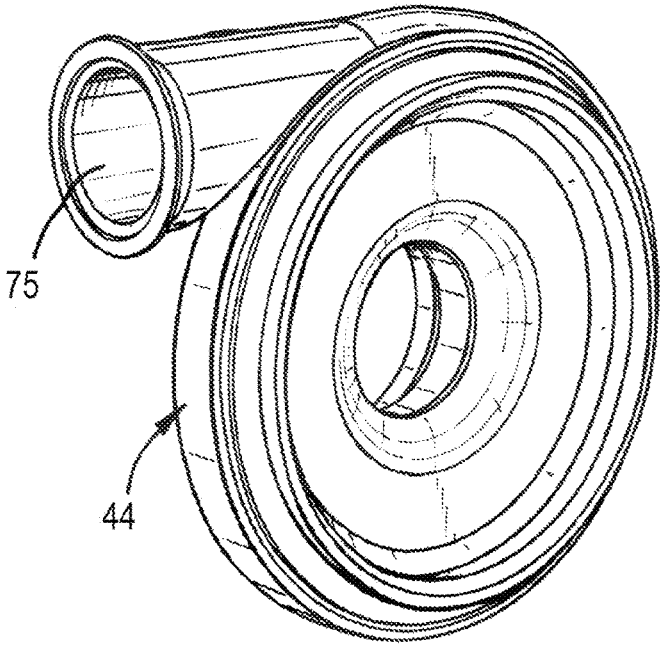
Fig. 2 (Prior Art)
FIG. 2 is a rear perspective view of a slightly different version of the compressor housing shown in FIG. 1 (with the impeller wheel omitted for illustrative purposes)
Figure 3:
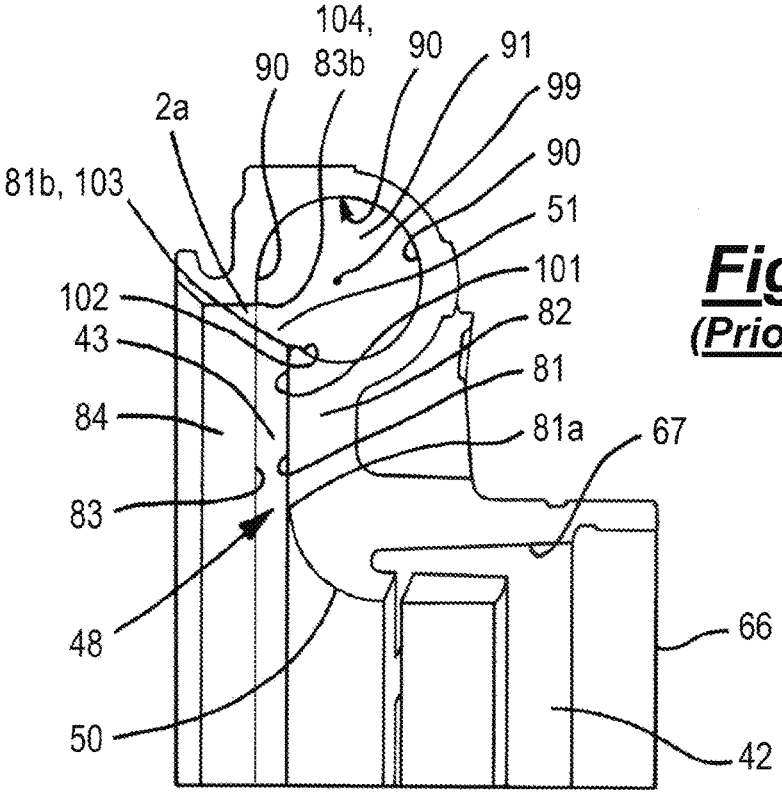
Fig. 3 (Prior Art)
FIG. 3 is a cross-sectional view of an upper half of the compressor housing shown in FIG. 2, taken along an axial plane.

Referring to FIGS. 1 to 3, this illustrates a known variable geometry turbocharger comprising a turbine 41 and a compressor 40 interconnected by a bearing assembly 60.

The turbine 41 comprises a turbine wheel 5 mounted on one end of a shaft 4 for rotation within a turbine housing 1. The compressor 40 comprises an impeller wheel 6 mounted on the other end of the shaft 4 for rotation within a compressor housing 2. The compressor housing 2 has a central longitudinal axis 4*a*.

The turbine housing 1 and the compressor housing 2 are interconnected by a central bearing housing 3. The turbocharger shaft 4 extends from the turbine housing 1 to the compressor housing 2 through the bearing housing 3. The shaft 4 rotates about an axis that is substantially parallel and co-incident with the longitudinal axis 4*a* of the compressor housing 2, on bearings located in the bearing housing 3.

In between the compressor housing 2 and the bearing housing 3 is a diffuser plate 2*a* which is recessed to accommodate an inboard portion of the compressor wheel 6, i.e. a portion nearest to the bearing housing 3, to increase the efficiency of the compressor 40.

The turbine housing 1 defines an inlet volute 7 to which gas from an internal combustion engine (not shown) is delivered. The exhaust gas flows from the inlet volute 7 to an axial outlet passage 8 via an annular inlet passage 9 and the turbine wheel 5. The inlet passage 9 is defined on one side by a face 10 of a radial wall of a movable annular wall member 11, commonly referred to as a "nozzle ring", and on the opposite side by an annular shroud 12 which forms the wall of the inlet passage 9 facing the nozzle ring 11. The shroud 12 covers the opening of an annular recess 13 in the turbine housing 1.

The nozzle ring 11 supports an array of circumferentially and equally spaced inlet vanes 14 each of which extends across the inlet passage 9. The vanes 14 are orientated to deflect gas flowing through the inlet passage 9 towards the direction of rotation of the turbine wheel 5. When the nozzle ring 11 is proximate to the annular shroud 12, the vanes 14 project through suitably configured slots in the shroud 12, into the recess 13.

The position of the nozzle ring 11 is controlled by an actuator assembly of the type disclosed in U.S. Pat. No. 5,868,552. An actuator (not shown) is operable to adjust the position of the nozzle ring 11 via an actuator output shaft (not shown), which is linked to a yoke 15. The yoke 15 in turn engages axially extending actuating rods 16 that support the nozzle ring 11. Accordingly, by appropriate control of the actuator (which may for instance be pneumatic or electric), the axial position of the rods 16 and thus of the nozzle ring 11 can be controlled. The speed of the turbine wheel 5 is dependent upon the velocity of the gas passing through the annular inlet passage 9. For a fixed rate of mass of gas flowing into the inlet passage 9, the gas velocity is a function of the width of the inlet passage 9, the width being adjustable by controlling the axial position of the nozzle ring 11. FIG. 1 shows the annular inlet passage 9 fully open. The inlet passage 9 may be closed to a minimum by moving the face 10 of the nozzle ring 11 towards the shroud 12.

The nozzle ring 11 has axially extending radially inner and outer annular flanges 17 and 18 that extend into an annular cavity 19 provided in the bearing housing 3. Inner and outer sealing rings 20 and 21 are provided to seal the nozzle ring 11 with respect to inner and outer annular surfaces of the annular cavity 19 respectively, whilst allowing the nozzle ring 11 to slide within the annular cavity 19. The inner sealing ring 20 is supported within an annular groove formed in the radially inner annular surface of the cavity 19 and bears against the inner annular flange 17 of the nozzle ring 11. The outer sealing ring 20 is supported within an annular groove formed in the radially outer annular surface of the cavity 19 and bears against the outer annular flange 18 of the nozzle ring 11.

Referring to FIGS. 2 and 3, the compressor housing 2 defines an axial intake 42 and an annular diffuser passage 43. The compressor housing 2 also comprises an annular outlet volute 44 defining an outlet volute passage 91.

The axial intake 42 is defined by a substantially annular radially inner surface 67 of the compressor housing 2 that is substantially centred on the compressor housing longitudinal axis 4*a*. The radially inner surface 67 extends axially inboard (i.e. towards the annular diffuser passage 43) from an intake port 66 to an annular intermediary surface 50.

The intermediary surface 50 extends from the axially inboard end of the radially inner surface 67 and is an extension of said inner surface 67. As the intermediary surface 50 extends from the axially inboard end of the inner surface 67, it curves from the axial direction 4*a* to the radial direction (relative to the compressor housing longitudinal axis 4*a*).

The annular diffuser passage 43 extends in the radial direction from a diffuser inlet 48 that is in fluid communication with the impeller wheel 6, to a diffuser outlet 51 that is in fluid communication with the annular outlet volute 44. The annular diffuser passage 43 is defined by a surface 81 of an annular diffuser first wall member 82 and an opposed surface 83 of an annular diffuser second wall member 84. In the described embodiment the annular diffuser second wall member 84 is formed by the diffuser plate 2*a*. The opposed surfaces 81, 83 are substantially parallel to each other and are substantially perpendicular to the longitudinal axis 4*a* of the compressor housing 2.

The surface 81 of the annular diffuser first wall member 82 has the general shape of a ring, substantially centred on the longitudinal axis 4*a* of the compressor housing 2. The surface 81 of the annular diffuser first wall member 82 extends radially outwardly from an inlet end 81*a* to an outlet end 81*b*. The surface 81 of the annular diffuser first wall member 82 has an outlet section 101 that extends radially inwardly from the outlet end 81*b*.

The surface 83 of the annular diffuser second wall member 84 is a substantially planar disc that is substantially continuous along its radial extent. The surface 83 has a radially outer end that forms an annular outlet end 83*b*.

The impeller wheel 6 is mounted on the shaft 4 between the axial intake 42 and the annular outlet volute 44. The impeller wheel 6 has a plurality of blades 45, each having a front radial edge 46 which in use rotates within the axial intake 42, a tip 47 which sweeps across the annular inlet 48 of the annular diffuser passage 43 and a curved edge 49 defined between the front radial edge 46 and the tip 47 which sweeps across the intermediary surface 50 of the compressor housing 2. In this regard, the intermediary surface 50 has a curved profile that substantially matches that of the impeller wheel blades 45.

Gas flowing from the turbine inlet volute 7 to the outlet passage 8 passes over the turbine wheel 5 and as a result torque is applied to the shaft 4 to drive the compressor wheel 6. Rotation of the compressor wheel 6 within the compressor housing 2 pressurizes ambient air present, draws air in through the intake port 66, through the axial intake 42 to the impeller wheel 6, which delivers the pressurized air through the annular diffuser passage 43 to the outlet volute 44. The air then delivered from an outlet 75 of the volute 44 from which it is fed to an internal combustion engine (not shown).

An inner surface 90 of the outlet volute 44 defines an annular outlet volute passage 91 that extends, along a circumferentially extending volute passage axis 99, about the compressor housing longitudinal axis 4*a* from a volute tail to the volute outlet 75. The volute 44 has a general scroll shape.

The inner surface 90 of the volute 44 extends, in a circumferential direction about the volute passage axis 99, from an inlet end 103, provided at the outlet end 81*b* of the surface 81 of the first annular diffuser wall member 82 to an annular radially outer end 104, provided at the outlet end 83*b* of the surface 83 of the second annular diffuser member 84. The inner surface 90 has a substantially constant radius, relative to the volute passage axis 99, such that the inner surface 90 has a substantially circular cross-sectional shape about the volute passage axis 99.

The inner surface 90 of the volute 44 has an annular first section 102 that extends axially outboard (i.e. away from the diffuser passage 43) from the annular outlet end 81*b* of the surface 81 of the first annular diffuser wall member 82.

It is known to form the first section 102 such that it extends radially inwardly (relative to the compressor housing longitudinal axis 4*a*) of the annular outlet end 81*b* of the surface 81 of the first annular diffuser wall member 82 to form a radially outwardly protruding annular lip 200 (see FIG. 1), curved along its radial extent, that extends along the annular outlet end 81*b* of the first surface 81. Providing this curved lip 200 is advantageous in that it acts to better align the circulating flow in the outlet volute 44, as it passes from the first section 102 of the inner surface 90 of the volute 44 towards the diffuser outlet 51, with the flow leaving the diffuser outlet 51, thereby reducing losses. The shape of the first section 102 to form the lip 200 is produced by appropriate shaping of the outer surface of a core around which the compressor housing is cast (for example a sand core or metal core, as described below).

An outlet volute may be formed from a single piece or from multiple pieces that are subsequently attached together.

It is known to use sand casting to produce a single piece closed volute with a cross sectional shape having the lip 200 shown in FIGS. 1 to 3. In sand casting, a die is located around a sand core. A suitable bonding agent (usually clay) is typically mixed with the sand and the mixture is moistened, typically with water, but sometimes with other substances, to provide the strength and plasticity of the core suitable for moulding. The sand is compacted around a mould to provide the required shape of the core.

The die is positioned to enclose the sand core to define a mould cavity between an inner surface of the die and an outer surface of the sand core. Accordingly, an inner surface of the die defines the shape of the outer surface of the outlet volute (as well as of the diffuser and axial intake) and an outer surface of the sand core defines the shape of the inner surface of the outlet volute (as well as of the diffuser and axial intake).

Molten metal is injected into the mould cavity. Once the molten metal cools and solidifies, the die is removed and the sand core is removed from the inside of the compressor housing by tipping the sand particles out through the volute outlet.

Sand casting is disadvantageous in that, during the casting process, the shape of the sand core can change, resulting in dimensional inconsistency. In addition, it produces a relatively poor surface finish which, during use, results in losses in the flow.

It is also known to use pressure die casting to produce a multiple piece closed volute with this cross sectional shape. In pressure die casting molten metal is forced under pressure into a mould cavity. The mould cavity is defined between an inner surface of a die and an outer surface of a metal core located within the die.

In this process, multiple sections of the compressor housing (opposed axial sections) are formed separately, using pressure die casting, and are then assembled together to form a volute inner surface with the above cross sectional shape (a circular cross-sectional shape provided with said lip). Pressure die casting is advantageous in that it provides a better surface finish than sand casting, which gives better performance and reduces losses in the flow. However, due to the interfaces between the multiple sections, the volute has problems of leakage and containment issues, resulting in losses and inefficiencies in the flow.

Furthermore, it is currently not possible to use pressure die casting to form a single piece volute having a cross sectional shape provided with said lip 200, since the lip 200 would prevent the metal core from being removed out of the volute after the casting process is complete.

In addition, due to the relatively high tooling costs with pressure die casting, it is necessary for high volumes of the compressor housing to be manufactured in order for the manufacturing process to be economically viable.

Figure 4:
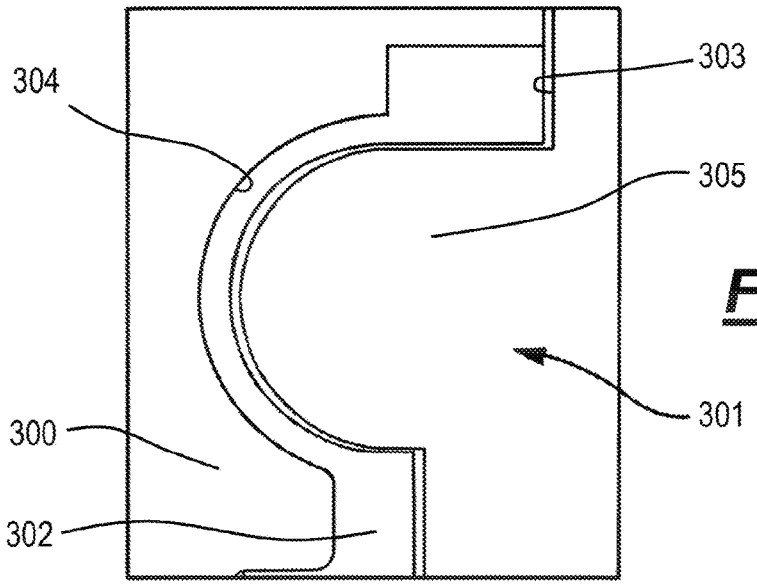
FIG. 4 is an axial cross-sectional view of a die and core for use in a method of manufacturing a compressor housing according to the method of the present disclosure.
Figure 5:
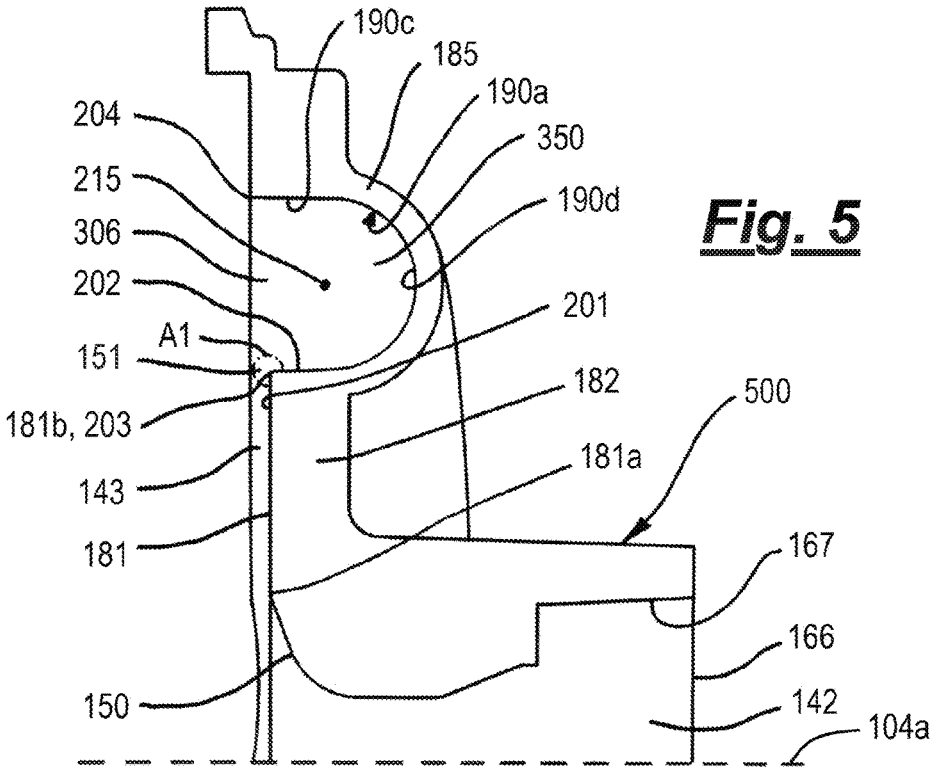
FIG. 5 is an axial cross-sectional view of an upper half of a compressor housing manufactured according to the method of the present disclosure but before a cut, according to the method, is made to the compressor housing.

Referring to FIG. 4 there is shown a die 300 and a core 301 suitable for forming the compressor housing shown in FIG. 5, using a method according to the first aspect of the present disclosure. The core 301 has an outer surface 303 that is shaped to define the inner surface of the compressor housing. The die 300 has an inner surface 304 shaped to define an outer surface of the compressor housing. In accordance with the method of the present disclosure, the core 301 is arranged with the die 300 so as to define a mould cavity 302 between said surfaces 303, 304 of the core 301 and die 300. The mould cavity 302 has a shape corresponding to that of the compressor housing to be formed.

In the described embodiment, the core is a solid core made of metal and the compressor housing is formed using pressure die casting. In this respect, molten metal is forced under pressure into the mould cavity 302. The molten metal is cooled and solidified within the mould cavity 302 to form the compressor housing 500 shown in FIG. 5. Once the compressor housing 500 has been formed in the mould cavity 302, it is removed from the mould cavity 302. In this respect, the mould 301 comprises a volute forming portion 305 that has an outer surface which defines the inner surface 190*a* of the volute 144 of the compressor housing 500 (see FIG. 5). As the core 301 is removed from the die 300 it is removed, in the direction of the longitudinal axis 4*a* of the compressor housing 500 through a radially extending opening 306 defined by the first wall member 185 (as described in more detail below).

Referring to FIG. 5 there is shown a compressor housing 500 formed by the above described pressure die casting method in relation to FIG. 4. The compressor housing 500 is similar to that of the compressor housing 2 shown in FIGS. 1 to 3 and corresponding features will be labelled with the same reference numerals incremented by 100. The differences between the compressor housing 500 of FIG. 5 and that shown in FIGS. 1 to 3 will be described below.

The compressor housing 500 has a longitudinal axis 104*a*. As with the compressor housing of FIGS. 1 to 3, the compressor housing 500 defines an axial intake 142. The axial intake 142 is defined by a substantially annular radially inner surface 167 of the compressor housing 500 that is substantially centred on the compressor housing longitudinal axis 104*a*. The radially inner surface 167 extends axially inboard (i.e. towards the annular diffuser passage 143) from an intake port 166 to an annular intermediary surface 150.

The intermediary surface 150 extends from the axially inboard end of the radially inner surface 167 and is an extension of said inner surface 167. As the intermediary surface 150 extends from the axially inboard end of the inner surface 167, it curves from the axial direction 4*a* to the radial direction (relative to the compressor housing longitudinal axis 104*a*).

The compressor housing 500 comprises an annular diffuser first wall member 182 having a surface 181 for defining, with an opposed surface 183 of an annular diffuser second wall member 184 (as described below in relation to FIG. 8). The surface 181 of the annular diffuser first wall member 182 extends radially outwardly from an annular inlet end 181*a*, provided at a radially outer end of the intermediary surface 150, to an annular outlet end 181*b*.

The surface 181 is substantially planar, extending in a radial plane relative to the compressor housing longitudinal axis 104*a*. The surface 181*a* has the general shape of a ring, substantially centred on the longitudinal axis 104*a*. The surface 181 extends in a plane that is substantially perpendicular to the longitudinal axis 104*a*.

The surface 181 has an outlet section 201 that extends radially inwardly from the outlet end 181*b*.

For the avoidance of doubt, the outlet section 201 extends in a radial plane that is substantially perpendicular to the longitudinal axis 104*a* of the compressor housing 500. The section of the compressor that defines axial intake 142 is formed integrally with the annular diffuser first wall member 182. The compressor housing 500 is formed as a single piece.

The compressor housing 500 also comprises an annular outlet volute first wall member 185. The annular outlet volute first wall member 185 has a surface 190*a* for defining, with an opposed surface 190*b* of an annular outlet volute second wall member 187, an annular outlet volute 144 (as described below in relation to FIG. 8). The surface 190*a* of the first wall member 185 of the outlet volute defines a volute channel 350 that extends along a volute channel axis 215, in the circumferential direction about the compressor housing longitudinal axis 104*a*, terminating at a volute outlet (not shown).

The inner surface 190*a* of the annular outlet first wall member 185 extends in a circumferential direction about the volute channel axis 215, from an inlet end 203, provided at the outlet end 181*b* of the surface 181 of the annular diffuser first wall member 182, to an annular radially outer end 204.

The surface 190*a* of the outlet volute first wall member 185 has an annular first section 202 that extends axially outboard (i.e. away from diffuser passage 143 formed when the diffuser first wall member 182 is assembled with the diffuser second wall member 187, as described below) from the inlet end 203. Referring to FIG. 5, the first section 202 is a section of the surface 190*a* that is substantially parallel to the axial direction 104*a*.

The surface 190*a* also has a radially outer section 190*c* that extends axially inboard from the radially outer end 204 of the surface 190*a*. The radially outer section 190*c* is substantially parallel to the axial direction 104*a*.

The first section 202 and the radially outer section 190*c* are joined by an annular base section 190*d*. The base section 190*d* is curved along its length in the circumferential direction about the volute channel axis 215 and has a substantially constant radius of curvature. In this regard, the surface 190*a* of the outlet volute first wall member 185 forms a substantially D-shaped cross-sectional shape about the volute channel axis 215. The first section 202 is substantially perpendicular to the outlet section 201 of the surface 181 of the annular diffuser first wall member 182.

The first section 202 of the surface 190*a* of the first wall member 185 of the outlet volute is of a substantially constant radius, relative to the compressor housing longitudinal axis 104*a*, across the length of the first section 202 in the circumferential direction about the volute channel axis 215. In this respect, the first section 202 defines a cylinder that extends in the axial direction 104*a*, along a longitudinal axis that is centred on and coincident with the longitudinal axis 104*a* of the compressor housing 500.

A first angle (A1) is subtended between the outlet section 201 of the surface 181 of the annular diffuser first wall member 182 and the first section 202 of the surface 190*a* of the annular outlet volute first wall member 185. The first angle is substantially 270°. A radial extending opening 306 is provided in the annular outlet volute first wall member 185. In more detail, the surface 190*a* of the volute first wall member 185 defines an annular opening 306 that extends radially between the inlet end 203 and the radially outer end 204 of the surface 190*a*.

After the compressor housing has been formed in the mould cavity 302, the volute forming portion 305 of the core 301 is removed from the volute passage 350 out through the opening 306. Because the first section 202 is substantially planar and extends in the axial direction 104*a*, this allows the volute forming portion 305 of the core 301 to be removed from within the volute passage 350.

The die 300 is also removed from the outer surface of the compressor housing 500.

As will now be described, a cut is then applied to a portion of the first section 202 of the surface 190*a* of the annular outlet first wall member 185. The shape of the surface 190*a* after the cut has been made is shown in FIG. 6.

The cut is applied through the opening 306 in the annular outlet volute first wall member 185 by the insertion of a cutting tool 700 (shown schematically in axial cross-section in FIG. 6) through the opening 306. A cutting surface 701 of the cutting tool is brought into contact with a portion of the first section 202 of the surface 190*a*.

The applied cut produces a cut section 210 of the surface 190*a*. The cut section 210 comprises three portions 210*a* to 210*c*. The portions 210*a*-210*c* are arranged in an end to end configuration, in the circumferential direction about the volute channel axis 215. In this regard, the first portion 210*a* extends from a first end provided at the inlet end 203 of the surface 190*a* to a second end. The first portion 210*a* is inclined at a second angle (A2), relative to the outlet section 201 of the surface 181 of the annular diffuser first wall member 182. The second angle (A2) is substantially 290°.

Figure 6:
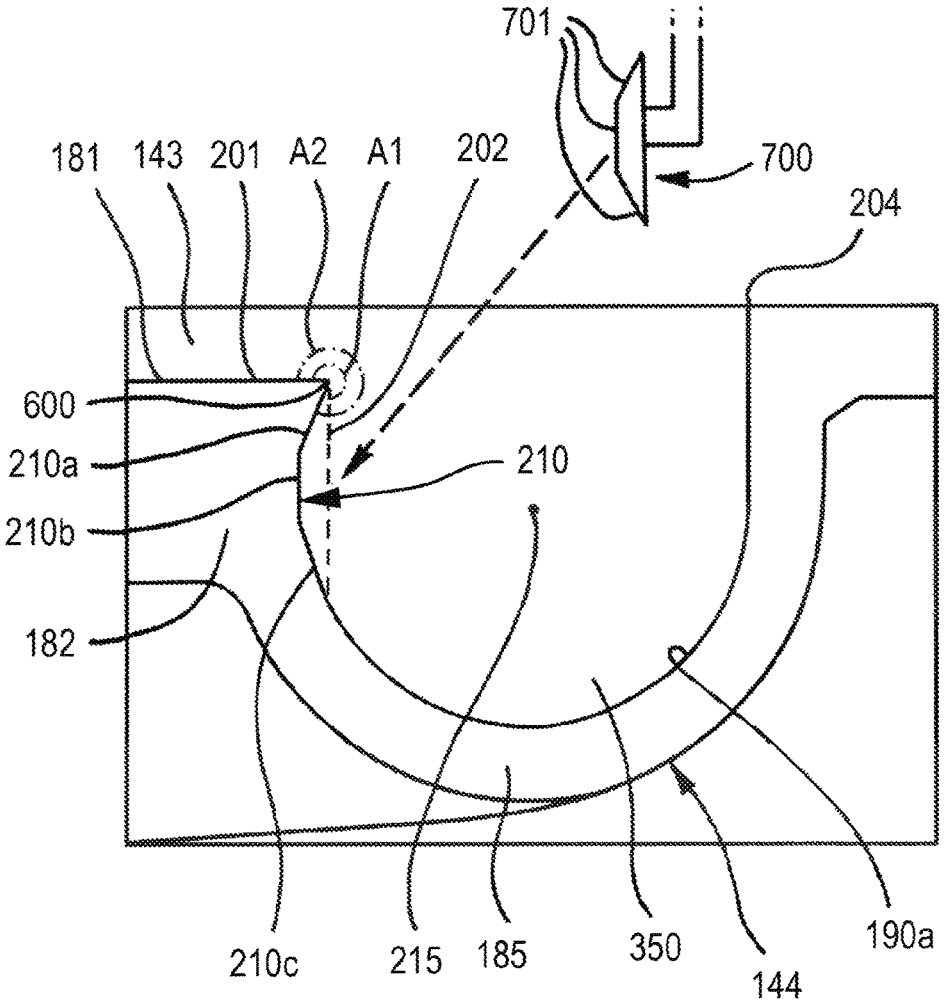
FIG. 6 is an enlarged cross-sectional view of the diffuser and volute of the compressor housing shown in FIG. 5, after the cut according to the method of the present disclosure has been made to the compressor housing.
Figure 7A:
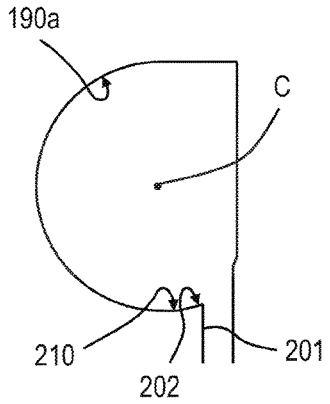
FIGS. 7*a* to 7*d* show views corresponding to that of FIG. 6, but taken along axial planes at 0°, 90°, 180° and 270° respectively, relative to the volute outlet.
Figure 7B:
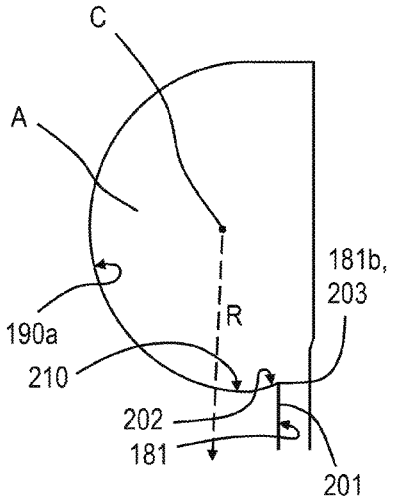
Figure 7C:
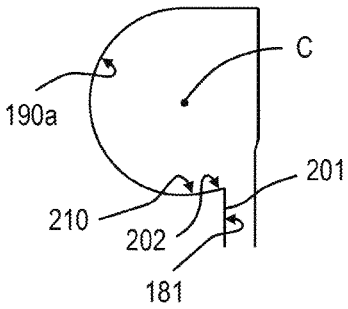
Figure 7D:
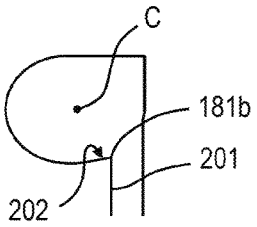

By reference to the axial plane shown in FIG. 6, it will be appreciated that the first and second angles (A1, A2) refer to the angles subtended at the same circumferential position about the longitudinal axis 104*a* of the compressor housing 500. In this regard, the first and second angles (A1, A2) are the angles subtended by the respective said surfaces in the same axial plane relative to the compressor housing longitudinal axis 104*a*.

A first end of the second portion 210*b* extends from the second end of the first portion 210*a* to a second end. A first end of the third portion 210*c* extends from the second end of the second portion 210*b* to a second end.

The cut section 210 has a length in the circumferential direction, about the volute channel axis 215, that is substantially 20% of the length of the surface 190*a* of the first wall member 185 of the outlet volute in the circumferential direction, about the volute channel axis 215.

The cut section 210 extends radially inwardly (relative to the longitudinal axis 104*a* of the compressor housing 500) of the outlet end 181*b* of the surface 181 of the annular diffuser first wall member 182. In this regard, the cut section 210 extends radially inwardly of the inlet end 203 of the surface 190*a* of the annular outlet first wall member 185. In this respect, the first portion 210*a* of the cut section 210 extends radially inwardly of the outlet end 181*b* of the surface 181 of the annular diffuser first wall member 182, from said outlet end 181*b*.

Each of the portions 210*a*-210*c* is at a different angle relative to the outlet section 201 of the surface 181 of the annular diffuser first wall member 182. As stated above, the first portion 210*a* is inclined relative to the outlet section 201 of the surface 181 of the annular diffuser first wall member 182 at an angle (A2) of substantially 290°. The second portion 210*b* is inclined relative to the outlet section 201 of the surface 181 of the annular diffuser first wall member 182 at an angle of substantially 270°. The third portion 210*c* is inclined relative to the outlet section 201 of the surface 181 of the annular diffuser first wall member 182 at an angle of substantially 250°.

The portions 210*a*-210*c* of the cut section 210 approximate a concave curve, relative to the volute passage axis 215, that faces into the volute channel 350 and has substantially the same radius as the radius of the base section 190*c*, relative to the volute passage axis 215.

The cut is made using a single cutting operation. In this regard, the cutting tool 700 is a lathe having an annular cutting surface that engages with the first section 202 of the surface 190*a* to form the cut section 210.

The cut is made by rotating the cutting surface 701 of the cutting tool 700 relative to the annular outlet volute first wall member 185, about the compressor housing longitudinal axis 104*a*. In this regard, the annular outlet first wall member 185 is held stationary and the cutting tool is rotated about the longitudinal axis 104*a* of the compressor housing 500. It will be appreciated that alternatively, or additionally, the compressor housing 500 may be rotated.

The cut is made substantially around the entire circumference of the first section 202 of the surface 190*a* of the outlet volute first wall member 185. Accordingly, the cut section 210 extends around substantially the entire circumference of the first section 202 (the circumference about the compressor housing longitudinal axis 104*a*). The cut section forms a lip 600 that extends in the circumferential direction about the compressor housing longitudinal axis 104*a*. The lip 600 also extends in the circumferential direction about the volute channel axis.

FIGS. 7A to 7D show the shape of the cut made at different circumferential positions relative to the compressor housing longitudinal axis 104*a*, specifically, taken along axial planes at 0°, 90°, 180° and 270° respectively, relative to the volute outlet.

The cut section 210 has a substantially constant shape with circumferential position about the compressor housing longitudinal axis 104*a*. In this regard, the length of the cut section 210, in the circumferential direction about the volute channel axis 215 is substantially constant with circumferential position about the compressor housing longitudinal axis 104*a*. Furthermore, the second angle (A2) is substantially constant with circumferential position about the compressor housing longitudinal axis. This is advantageous in that it allows for a simpler machining operation to machine the cut. Specifically, it allows the cuts to be machined in a single operation using the lathe.

The second angle (A2) is greater than the first angle (A1) subtended between the outlet section 201 of the surface 181 of the annular diffuser first wall member 182 and the uncut first section 202 of the surface 190*a* of the annular outlet volute first wall member 185. This acts to better align the circulating flow in the outlet volute as it passes from the first section 202 (i.e. the cut section 210) of the surface 190*a* towards the diffuser outlet 151, with the flow leaving the diffuser outlet 151 thereby reducing losses.

The cut is made using a single cutting operation using a single continuous rotation of the cutting surface relative to the surface 190*a*.

It will be appreciated that the angles referred to in this description (and the claims) are the external angles subtended by the outwardly facing respective surfaces (as opposed to the internal angle subtended by the surfaces).

The outlet end 181*b* of the surface 181 of the annular diffuser first wall member 182 has a radius, relative to the compressor housing longitudinal axis 104*a*, that is substantially constant with its circumferential position about said longitudinal axis 104*a*. This is advantageous in that it allows for a simpler machining operation to machine the cut. Specifically, it allows the cut to be machined in a single turning operation. This allows the cut to be made using a lathe.

Referring to FIGS. 7*a* to 7*d*, there is shown the position of the centroid (C) of the cross-sectional area (A) (taken in an axial plane) of the volute at each circumferential position shown. The centroid (C) has a centroid radius (R), which is the radius of the centroid (C) relative to the longitudinal axis 104*a*. The volute is shaped such that the ratio of the volute cross-sectional area (A) (taken in an axial plane) to the centroid radius (R) decreases linearly with circumferential position from the volute outlet 75 to the volute tail. The above described method of casting the compressor housing 500 around a core 301, removing the core through the opening 306 and applying the described cut through the opening 306 in the outlet volute first wall member 185 allows pressure die casting (or any suitable type of casting) to be used to produce a single piece volute with a cross-sectional shape that better aligns the circulating flow in the outlet volute with the flow leaving the diffuser than was otherwise possible. Pressure die casting is advantageous in that it provides a good surface finish, which reduces losses in the flow.

Figure 8:
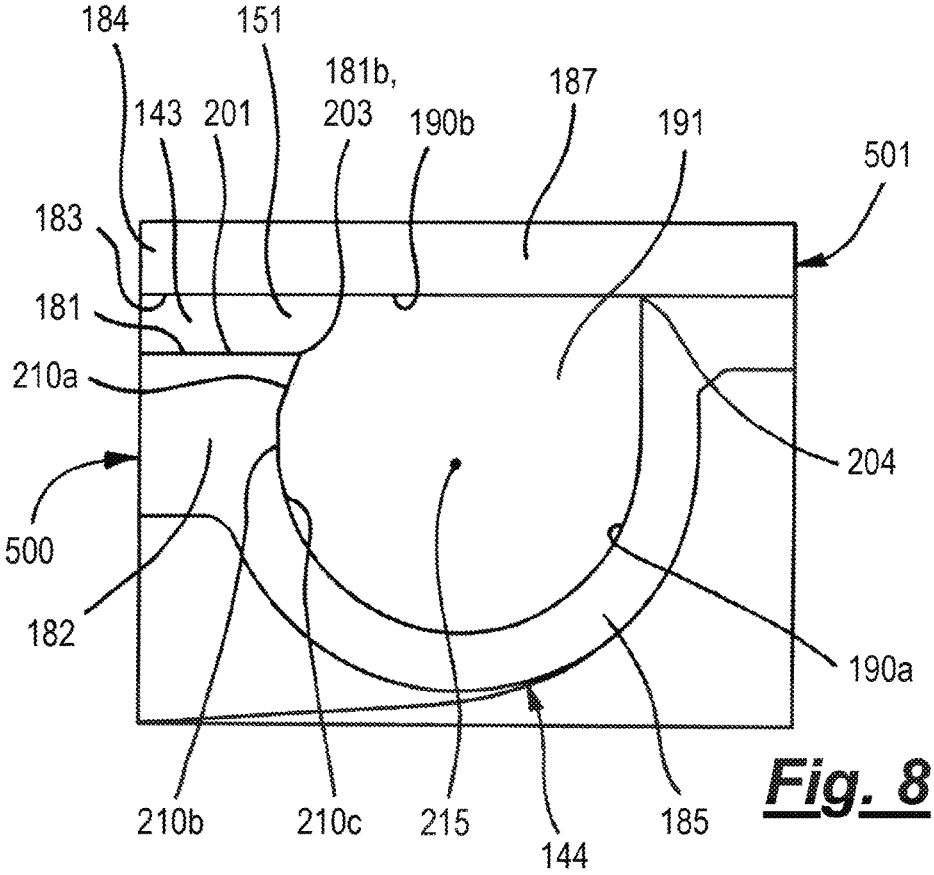
FIG. 8 is a view corresponding to that of FIG. 6, but where the compressor housing is assembled with a wall member of a bearing housing to form a compressor.

Referring to FIG. 8, the cut compressor housing 500 of FIG. 6 is assembled with a body 501, and an impeller (not shown) is mounted within the compressor housing 500, to form a compressor.

In more detail, the body 501 is a wall member of a bearing assembly of a turbocharger (such as the bearing assembly 60 of the turbocharger of FIG. 1). The body 501 is a radially extending substantially planar body.

The body 501 has a radially inner section that forms an annular diffuser second wall member 184. The annular diffuser second wall member 184 has a surface 183 that is substantially parallel to the radial direction, relative to the compressor housing longitudinal axis 104*a*, and the body 501 is mounted to the compressor housing 500 such that the surface 183 of the annular diffuser second wall member 184 is opposed to the surface 181 of the annular diffuser first wall member 182 and defines an annular diffuser passage 143 therewith.

The annular diffuser passage 143 extends from an inlet to an outlet 151 as with the diffuser passageway of FIGS. 1 to 3.

A radially outer section of the body 501 forms an annular volute second wall member 187. The body 501 is mounted to the annular outlet first wall member 185 such that the radially outer section of the body forms an annular outlet volute second wall member 187 with a surface 190*b* of the annular outlet volute second wall member 187 being opposed to the surface 190*a* of the annular outlet first wall member 185 and defining a volute passage 191 therewith. In this regard, the surface 190*b* closes the opening 306 in the annular outlet first wall member 185, with the volute channel 350 now forming the volute passage 191. In this regard, the surface 190*b* of the second annular outlet volute wall member 187 abuts the radially outer end 204 of the surface 190*a* of the annular outlet volute second wall member 187 provides a closed radially outer end of the volute passage 191.

The compressor may be assembled with a turbine to form a turbocharger (e.g. using the arrangement of a compressor, bearing assembly and turbine as shown in FIG. 1).

Figure 9:
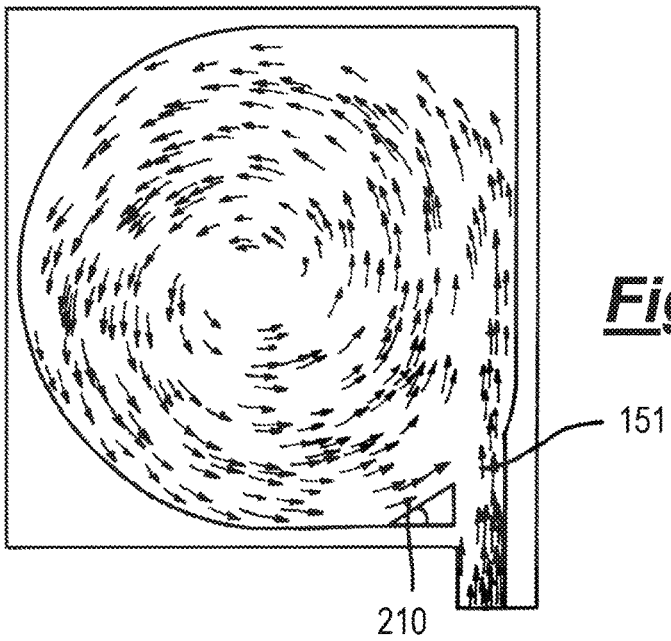
FIG. 9 is a schematic flow diagram showing the direction of flow in the compressor of FIG. 8, during use.

FIG. 9 is a flow diagram showing the direction and magnitude of the flow being the volute 144 of FIG. 8 at the circumferential position of FIG. 8. It can be seen from FIG. 9 that, due to the cut, a flow passing along the cut section 210 towards the diffuser outlet 151 is better aligned with the flow leaving the diffuser outlet (than if the cut had not been made). This reduces losses in the flow, thereby improving the performance of the compressor.

Figure 10:
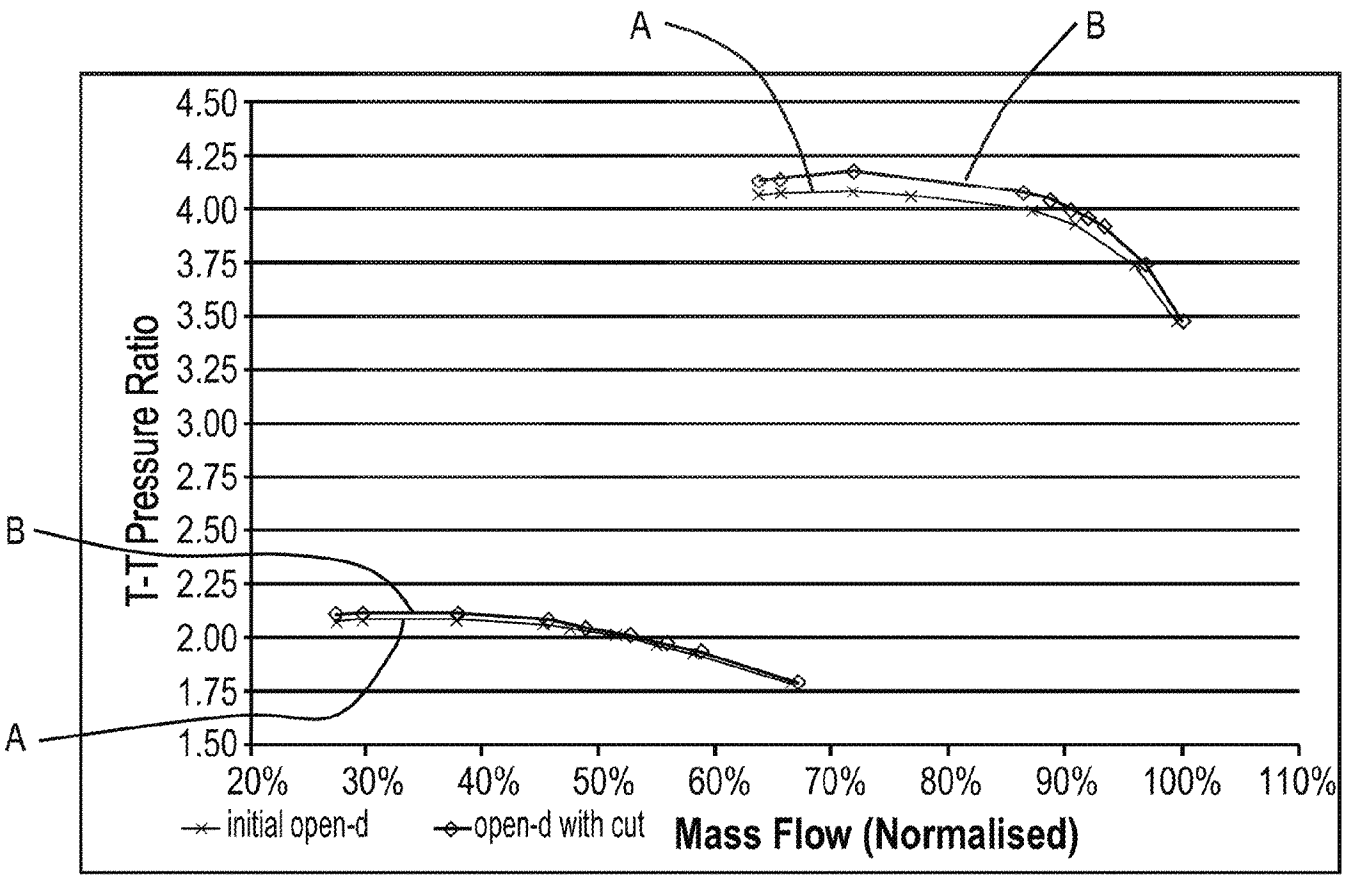
FIG. 10 is a graph showing the variation of total pressure ratio (t-t) across the compressor (i.e. between the compressor inlet and volute outlet) with normalized mass flow for a compressor with an open 'D-section' volute (such as the compressor housing shown in FIG. 5 (i.e. before the cut is made)) and for the compressor of FIG. 8 (i.e. after the cut has been made)
Figure 11:
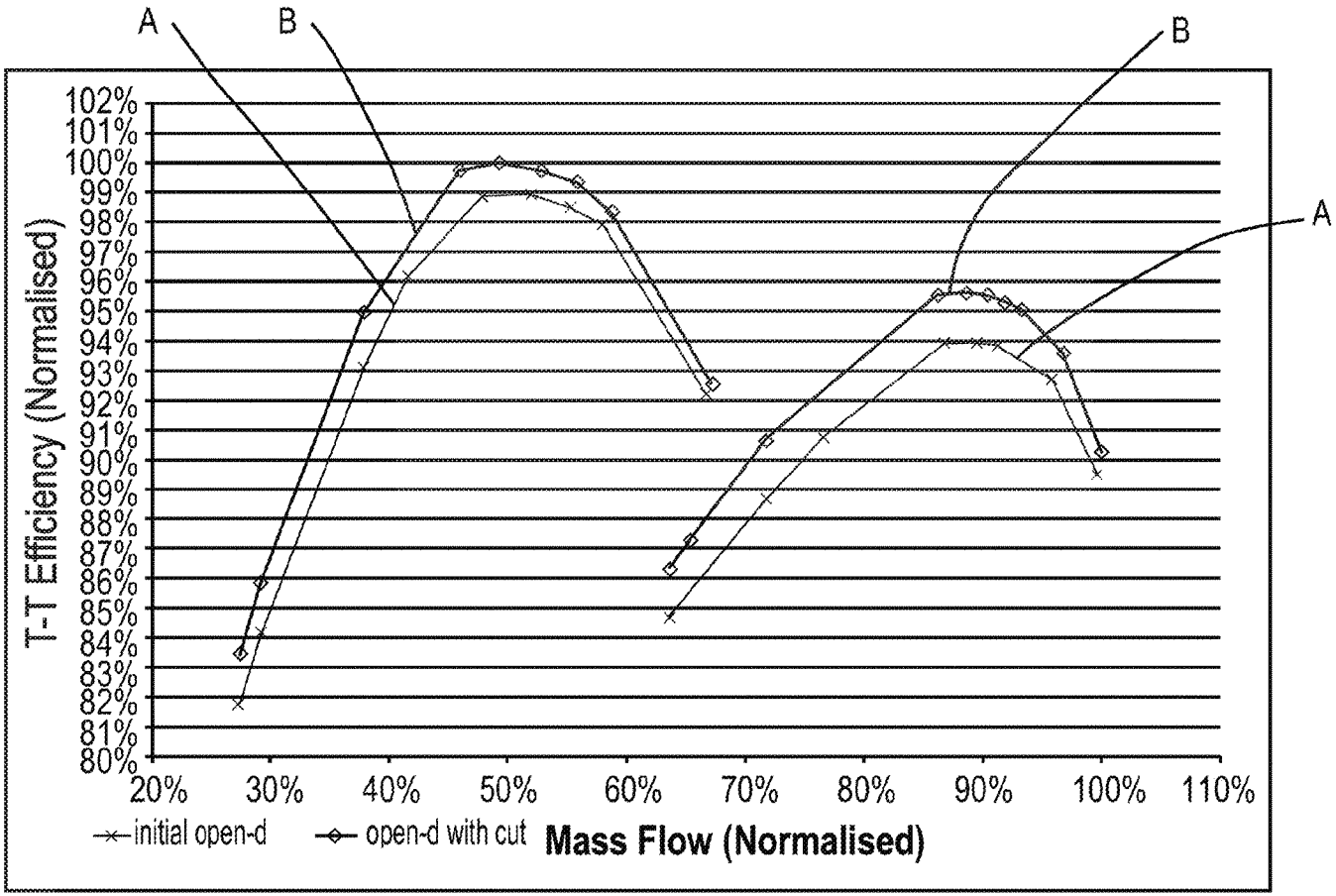
FIG. 11 is a graph showing the variation of total efficiency (t-t) across the compressor (i.e. between the compressor inlet and volute outlet) with normalised mass flow for a compressor with an open 'D-section' volute (such as the compressor housing shown in FIG. 5 (i.e. before the cut is made)) and for the compressor of FIG. 8 (i.e. after the cut has been made)

The improvement in performance obtained by making the cut is shown in FIGS. 10 and 11.

FIG. 10 is a graph showing the variation of total pressure ratio (t-t) across the compressor with normalized mass flow for a compressor with an open 'D-section' volute (such as the compressor housing shown in FIG. 5 (i.e. before the cut is made)), shown by the line 'A' and for the compressor of FIG. 8 (i.e. after the cut has been made), shown by the line 'B'.

From FIG. 10 it can be seen that for the compressor of FIG. 8 (i.e. where the cut has been made), the total to total pressure ratio is higher across the entire range of normalized mass flow through the compressor, than for the compressor housing shown in FIG. 5 (i.e. where the cut has not been made).

FIG. 11 is a graph showing the variation of total efficiency (t-t) across the compressor with normalized mass flow for a compressor with an open 'D-section' volute (such as the compressor housing shown in FIG. 5 (i.e. before the cut is made)), shown by the line 'A' and for the compressor of FIG. 8 (i.e. after the cut has been made), shown by the line 'B'.

From FIG. 11 it can be seen that for the compressor of FIG. 8 (i.e. where the cut has been made), the total to total efficiency ratio is higher across the entire range of normalized mass flow through the compressor, than for the compressor housing shown in FIG. 5 (i.e. where the cut has not been made).

As can be seen from the above, the above method of manufacture is advantageous in that casting the compressor housing around a core within a die, removing the core and applying the above described cut through the opening in the outlet volute first wall member allows pressure die casting to be used to produce a single piece volute with a cross sectional shape that better aligns the circulating flow in the outlet volute with the flow leaving the diffuser, than was otherwise possible, since the core may be removed through the opening in the outlet volute, before the cut is made. Pressure die casting is advantageous in that it provides a good surface finish, which reduces losses in the flow.

It will be appreciated that numerous modifications to the above described method may be made without departing from the scope of the disclosure as defined by the claims.

For example, in the described embodiment, the cut section 210 extends from the outlet end 181*b* of the surface 181 of the annular diffuser first wall member 182. Alternatively, the cut section may extend from a first end disposed at a point between said outlet end 181*b* (i.e. the inlet end 203 of the surface 190*a*) and the radially outer end 204 of the surface 190*a*.

In the described embodiments, the cut section comprises a plurality of said portions 210*a*-210*c*. Alternatively, the cut section 210 may comprise more or fewer cut portions. For example, the cut section may comprise only a single portion, for example the portion 210*a*.

In the described embodiments, the angle of the cut portion 210*a* relative to the outlet section 201 of the surface 181 is substantially 290°. The second angle may be greater than or equal to 270°, preferably greater than 270°. The cut section may be at an angle to said outlet section that is greater than 270° and less than 350°. Preferably the cut section is at an angle to said outlet section that is greater than or equal to 280° and less than or equal to 320°. Preferably the cut section is at an oblique angle to the outlet section of the surface of the diffuser first wall member, at the at least one circumferential position.

In the described embodiments, each cut portion 210*a*-210*c* is substantially planar. However, it will be appreciated that one or more of said cut portions may be curved in the circumferential direction relative to the volute passage axis 215.

Before the cut is made, the surface 190*a* of the outlet volute first wall member 185 may have a radius relative to the volute channel axis 215 that is substantially constant with the circumferential position of said surface (about the volute channel axis). In this regard, before the cut is made, the surface of the outlet volute first wall member 185 may form a substantially circular cross-sectional shape about the volute channel axis 215. The surface 190*a* may have any suitable cross-sectional shape.

The cut section 210 may have a length in the circumferential direction, about the volute channel axis 215, that is less than or equal to half the length of the surface 190*b* of the first wall member 185 of the outlet volute in the circumferential direction, about the volute channel axis. Said length of the cut section may be less than or equal to 50% of said length of the surface 190*b*, preferably less than or equal to 50% and greater than or equal to 5%, more preferably less than or equal to 40% and greater than or equal to 10% and even more preferably less than or equal to 30% and greater than or equal to 20% of said length.

In the described embodiment the cut, and therefore the cut section, extends substantially around the circumference of the first section 202 of the surface 190*a* in the circumferential direction about the compressor housing longitudinal axis 104*a*. Alternatively, the cut, and therefore the cut section 210, may extend only partly around said longitudinal axis 104*a* in the circumferential direction.

In the above described embodiment, the cut section has a substantially constant cross-sectional shape in the circumferential direction about the compressor housing longitudinal axis 104*a*. Alternatively, the cut section may have a varying cross-sectional in said circumferential direction.

Furthermore, the outlet end 181*b* of the surface 181 of the annular diffuser first wall member 182 may have a varying radius with circumferential position about the compressor housing longitudinal axis 104*a*.

In the above described embodiments, pressure die casting is used to form the compressor housing 500.

Alternatively, the core may be a core of a particulate material. In this respect, the core may be made of sand or of any other suitable particulate material. The molten metal may be provided in the mould cavity by being injected, or poured into the mould cavity. The molten metal may be gravity-fed into the mould cavity.

Figure 12:
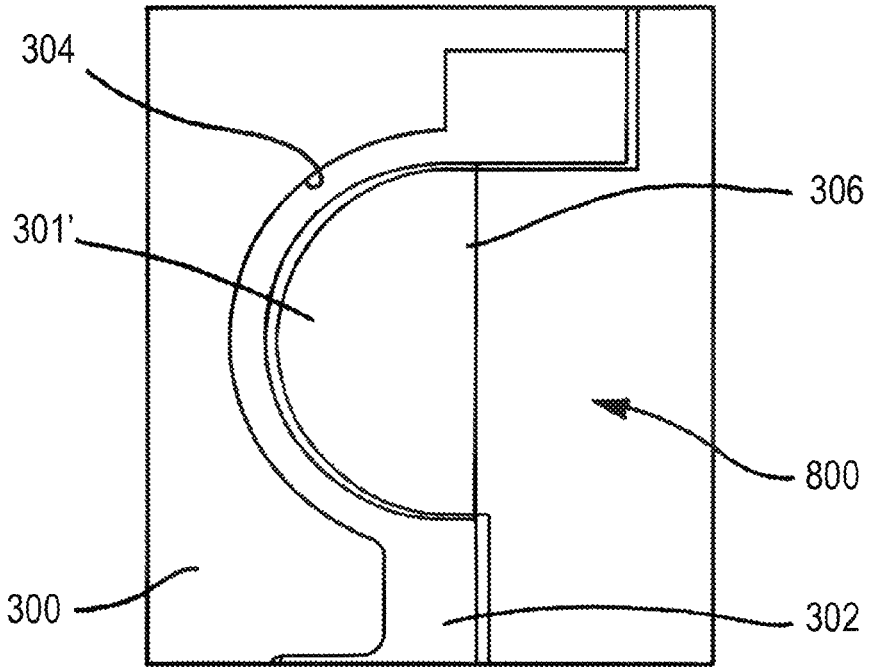
FIG. 12 is a view corresponding to that of FIG. 4, but where the core is a sand core 301'.

Referring to FIG. 12, there is shown a view corresponding to that of FIG. 4, but where the core is a sand core 301'. Where the core is a core of a particulate material, such as a sand core 301', the core is supported through the opening 306 in the outlet volute first wall member 185 by an annular support member 800. In this respect, the sand core 301' is supported through the opening 306 substantially across the entire circumferential length of the core 301', about the compressor housing longitudinal axis 104*a*. This is advantageous in that it reduces any shifting of the sand core 301' during the casting process, providing increased dimensional consistency.

The sand core 301' can primarily be removed from the compressor housing 500 through the opening 306, but may alternatively, or additionally, be removed through an outlet 75 of the volute.

In the described embodiments, the body 501 is formed by a bearing assembly. Alternatively, the body may be formed by any suitable component of a turbocharger including a diffuser plate.

In the described embodiments, the compressor housing 500 is cut using a single continuous cutting operation. Alternatively, a plurality of different cutting operations may be used.

In the described embodiments, the section of the compressor housing forming the axial intake 142 is formed integrally with the annular diffuser first wall member 182. Alternatively, the axial intake 142 may be formed separately with the annular diffuser first wall member 182 and attached thereto by any suitable attachment means.

In the described embodiments, the surface 181 of the annular diffuser first wall member is substantially perpendicular to the longitudinal axis 104*a*. Alternatively, the surface 181 may be inclined relative to the perpendicular to the longitudinal axis 104*a*, i.e. relative to the radial direction.

Furthermore, the outlet section 201 may be inclined relative to the perpendicular to the longitudinal axis 104*a*, i.e. relative to the radial direction.

In addition, the surface 181 of the annular diffuser first wall member, including the outlet section 201, may be curved.

What is claimed is:

1. A method of manufacturing a compressor housing comprising:

arranging a core with a die so as to define a mould cavity between a surface of the core and a surface of the die, the mould cavity having the shape of a compressor housing;

providing a molten metal within the mould cavity and solidifying the molten metal to form a compressor housing;

the compressor housing having a longitudinal axis and being for receipt of an impeller wheel, mounted for rotation about an axis;

the compressor housing comprising an annular diffuser first wall member having a surface for defining, with an opposed surface of an annular diffuser second wall member, an annular diffuser passage of a diffuser;

the surface of the first wall member of the diffuser extending radially outwardly from an annular inlet end to an annular outlet end and having an annular outlet section extending radially inwardly from the outlet end;

the compressor housing further comprising an annular outlet volute first wall member having a surface for defining, with a surface of an annular outlet volute second wall member, an annular outlet volute passage;

the surface of the annular outlet volute first wall member defining a volute channel that extends, along a circumferentially extending volute channel axis, orthogonal to the compressor housing longitudinal axis;

the surface of the annular outlet volute first wall member having an annular inlet end, provided at the outlet end of the surface of the first wall member of the diffuser, the surface of the annular outlet volute first wall member having an annular first section that extends axially outboard from the annular inlet end;

the compressor housing being formed such that for at least one circumferential position about the compressor housing longitudinal axis, a first angle is subtended between the outlet section of the surface of the diffuser first wall member and the first section of the surface of the outlet volute first wall member;

the outlet volute first wall member being formed with an opening;

removing the core from the volute channel after the compressor housing has been formed in the mould cavity, and after the core has been removed from the volute channel, applying a cut through the opening, to the first section of the surface of the outlet volute first wall member, at the least one circumferential position, to produce a cut section such that a second angle is subtended between the cut section and the outlet section of the surface of the diffuser first wall member, at said at least one circumferential position, that is greater than the first angle.

2. The method of manufacturing a compressor housing according to claim 1 wherein the cut section extends radially inwardly of the outlet end of the surface of the first wall member of the diffuser, at the at least one circumferential position.

3. The method of manufacturing a compressor housing according to claim 1 wherein the cut section forms a lip that extends in the circumferential direction about the volute channel axis.

4. The method of manufacturing a compressor housing according to claim 1 wherein the cut section is at an oblique angle to the outlet section of the surface of the diffuser first wall member, at the at least one circumferential position.

5. The method of manufacturing a compressor housing according to claim 1 wherein the cut section is at an angle to the outlet section of the surface of the diffuser first wall member, at the at least one circumferential position, that is greater than or equal to 270°.

6. The method of manufacturing a compressor housing according to claim 1 wherein the surface of the first wall member of the outlet volute extends in a circumferential direction about the volute channel axis, from the inlet end of said surface to a radially outer end of said surface and the surface of the first wall member of the outlet has a radius, relative to the volute channel axis, that varies with a circumferential position of said surface about the volute channel axis.

7. The method of manufacturing a compressor housing according to claim 1 wherein the cut section extends from a first end, to a second end, in the circumferential direction about the volute channel axis wherein the first end of the cut section is provided at the inlet end of the surface of the first wall member of the outlet volute, at the at least one circumferential position.

8. The method of manufacturing a compressor housing according to claim 1 wherein the cut section has a length in the circumferential direction, about the volute channel axis, that is less than or equal to half the length of the surface of the first wall member of the outlet volute in the circumferential direction, about the volute channel axis.

9. The method of manufacturing a compressor housing according to claim 1 wherein the angle of the cut section relative to the outlet section of the surface of the first wall member of the diffuser, at the at least one circumferential position, is substantially constant along its length in the circumferential direction about the volute channel axis.

10. The method of manufacturing a compressor housing according to claim 1 wherein the angle of the cut section relative to the outlet section of the surface of the first wall member of the diffuser, at the at least one circumferential position, varies along its length in the circumferential direction about the volute channel axis.

11. The method of manufacturing a compressor housing according to claim 1 wherein the cut is made by a single cutting operation.

12. The method of manufacturing a compressor housing according to claim 1 wherein the at least one circumferential position is a plurality of circumferential positions about the compressor housing longitudinal axis.

13. The method of manufacturing a compressor housing according to claim 1 wherein, before the cut is made, the first section of the surface of the first wall member of the outlet volute, at the at least one circumferential position, is of a substantially constant radius, relative to the compressor housing longitudinal axis, across the length of the first section in the circumferential direction about the volute channel axis.

14. The method of manufacturing a compressor housing according to claim 1 wherein, before the cut is made, the first section is substantially perpendicular to the outlet section of the surface of the diffuser first wall member, at the at least one circumferential position.

15. The method of manufacturing a compressor housing according to claim 1 wherein the outlet volute is formed as a single piece.

16. The method of manufacturing a compressor housing according to claim 1 wherein the core is a solid core.

17. The method of manufacturing a compressor housing according to claim 1 wherein the core is of a particulate material.

18. The method of manufacturing a compressor housing according to claim 1 wherein the core is removed from the compressor housing through the opening in the outlet volute first wall member.

19. A method of manufacturing a compressor comprising:

manufacturing a compressor housing according to the method of claim 1;

providing a body having an annular diffuser second wall member and an annular outlet volute second wall member, assembling the body with the compressor housing such that the surface of the annular diffuser first wall member and a surface of the annular diffuser second wall member define an annular diffuser passage and the surface of the annular outlet volute first wall member and a surface of the annular outlet volute second wall member define an annular outlet volute that is downstream of and in fluid communication with the diffuser passage;

mounting an impeller within the compressor housing, the impeller being mounted on a shaft for rotation about said longitudinal axis, the impeller having a plurality of blades defining tips, the diffuser passage surrounding the impeller, with the tips of the blades sweeping across said diffuser inlet during use.

20. The method of manufacturing a turbocharger comprising manufacturing a compressor according to claim 19 and assembling the compressor with a turbine and bearing assembly to form a turbocharger.

* * * * *